United States Patent [19]

Castor

[11] 3,999,762

[45] Dec. 28, 1976

[54] EXERCISING DEVICE FOR WHEEL CHAIR CONFINED PERSONS

[76] Inventor: Arthur Lee Castor, 1409 W. 156th St., Compton, Calif. 90220

[22] Filed: Sept. 27, 1974

[21] Appl. No.: 509,857

[52] U.S. Cl. ..... 272/144; 248/441 R

[51] Int. Cl.[2] ..... A63B 21/00

[58] Field of Search ..... 272/58, 57, 70.4, 70.3; 248/118, 127, 441; 128/25

[56] References Cited

UNITED STATES PATENTS

| | | | |
|---|---|---|---|
| 2,556,121 | 6/1951 | Thomas | 272/70.3 |
| 3,099,101 | 7/1963 | Burris | 248/441 |
| 3,442,276 | 5/1969 | Edwards et al. | 272/70.3 X |
| 3,570,477 | 3/1971 | Scrivner | 272/58 X |

FOREIGN PATENTS OR APPLICATIONS

| | | | |
|---|---|---|---|
| 1,491,561 | 6/1969 | Germany | 272/70.3 |
| 1,048,148 | 4/1966 | United Kingdom | 272/70.3 |

*Primary Examiner*—Richard C. Pinkham
*Assistant Examiner*—William R. Browne
*Attorney, Agent, or Firm*—William C. Babcock

[57] ABSTRACT

A portable device, which in a first configuration permits a person having the use of his arms, but due to a disability of his legs is confined to a wheel chair, to pull himself to an erect supported position on the device, and thereafter, exercise. The device is capable of being dismantled for the elements thereof to nest together in a second configuration, with the device when in the second configuration, occupying a minimum of space and capable of being easily transported from one location to another. The device includes a base assembly having a rigid sheet wherein the sheet has forward, rearward and intermediate pairs of transversely aligned upstanding studs, a U-shaped rigid member that has a pair of spaced legs, a web, forward, rearward, and intermediate pairs of transversely aligned sleeves that project downwardly from the rigid member. Said sleeves are vertically aligned with the studs. The device, when assembled in a first configuration has detachable tubes connecting the aligned sleeves and studs. When the device is disassembled to a second configuration the sleeves and studs nest together. A pair of laterally spaced crutch like members are disposed adjacent the intermediate first tubes when the device is in the first configuration. A cushion is positioned between the intermediate tubes to receive the knees of a user when he is raising himself to a position so that he may use the crutch-like member. The cushion is also used when the user is lowering himself from the crutch like members to an adjacent wheel chair.

10 Claims, 9 Drawing Figures

EXERCISING DEVICE FOR WHEEL CHAIR CONFINED PERSONS

BACKGROUND OF THE INVENTION

1. Field of the Invention

Exercising device for wheel chair confined persons.

2. Description of the Prior Art

Numerous persons that have free and unimpaired use of their arms, but have a physical disability in their legs are confined to wheel chairs. For the well being of such persons it is essential that they exercise, and in the past, such exercising has been difficult to achieve.

The primary purpose in devising the present invention is to supply a portable device that may be assembled into a first configuration whereby a person confined to a wheel chair may manipulate the wheel chair to a position adjacent thereto, and by use of his arms pull himself into an upright position on the device where he is supported by crutch like members, and when so supported the person is capable of carrying out exercises that are not possible when he is confined to a wheel chair.

Another object of the invention is to supply an exercising device for wheel chair confined persons that is of relatively simple mechanical structure, can be fabricated from standard commercially available materials, is simple and easy to use, may be readily transported from one location to another when in a dismantled second configuration, and one that may be retailed at a sufficiently low price as to encourage the widespread use thereof by persons that have a need for the same.

SUMMARY OF THE INVENTION

A portable device which in a first configuration permits a person having the use of his arm, but due to an infirmity of his legs is confined to a wheel chair having forwardly and rearwardly disposed sets of wheels, to exercise and the device capable of being dismantled from the first configuration to a second configuration where the elements thereof nest together and occupy a minimum of space to permit convenient transportation of the device from one location to another.

The device in detail has a base assembly that includes a rigid sheet that has a first floor contactable side and a second upwardly disposed side, with the sheet having forwardly and rearward ends, and the rearward end tapering downwardly to permit the forwardly disposed set of wheels of the wheel chair to roll upwardly onto the second side of the sheets. The sheet has forward, rearward, and intermediately positioned pairs of transversely aligned studs that project upwardly from the second sides thereof, when the device is in the first configuration and the first side of the sheet rests on the floor surface.

The device also includes a support assembly that includes a generally U-shaped rigid member that has a pair of spaced legs that have forward and rearward ends, a web that joins the forward ends of the legs, and forward, rearward and intermediately disposed pairs of transversely aligned sleeves that project downwardly from the legs and are vertically alignable with the studs previously identified.

The sleeves are of such interior transverse cross section as to permit the sleeves to slidably and snuggly engage the studs when the device is in the second configuration for the members and sheets to cooperate to define a space therebetween. Forward, rearward and intermediate disposable pairs of elongate first tubes are provided that are vertically positionable, with the first tubes having upper first end portions and lower second end portions. The first end portions are of lesser transverse cross section than the balance of the tubes to permit the first end portion to slidably and snuggly engage the sleeves when the device is in the first configuration. The second end portions of the tubes slidably engage the studs when the device is disposed in the first configuration.

First means are provided on the sleeve for removably gripping the first end portions of the first tubes when the device is in the first configuration. Second means are provided on the second end portion of the tubes for removably holding the second end portions thereof in locked engagement with the studs when the device is in the first configuration.

A pair of laterally spaced crutch-like means are provided that are adjacently disposed to the intermediate first tubes when the device is in the first configuration. Third means are provided on the intermediate first tubes for adjustably and removably supporting the crutch like means at desired upwardly extending positions relative the intermediate first tubes when the device is in the first configuration.

The device also includes a cross piece and fourth means for removably securing the cross piece to the pair of intermediate tubes when the device is in the first configuration. The cross piece supports a rearwardly extending cushion, with the person using the device advancing the wheel chair relative to the base until the forward wheels of the wheel chair rest on the second side, and the person thereafter grasping the legs of the support assembly with the legs of the person in contact with the cushion to pull himself to an upright position where the crutch means may be extended under his arms for support to permit the person to exercise.

The person using the device returns to the wheel chair by reversing the above sequence of steps. When the device is not in use it is disposed in the second configuration, with the first tubes, crutch like means, and cross piece disposed in the space defined between the base assembly and the support assembly.

DESCRIPTION OF THE PREFERRED EMBODIMENT

Figure 1:
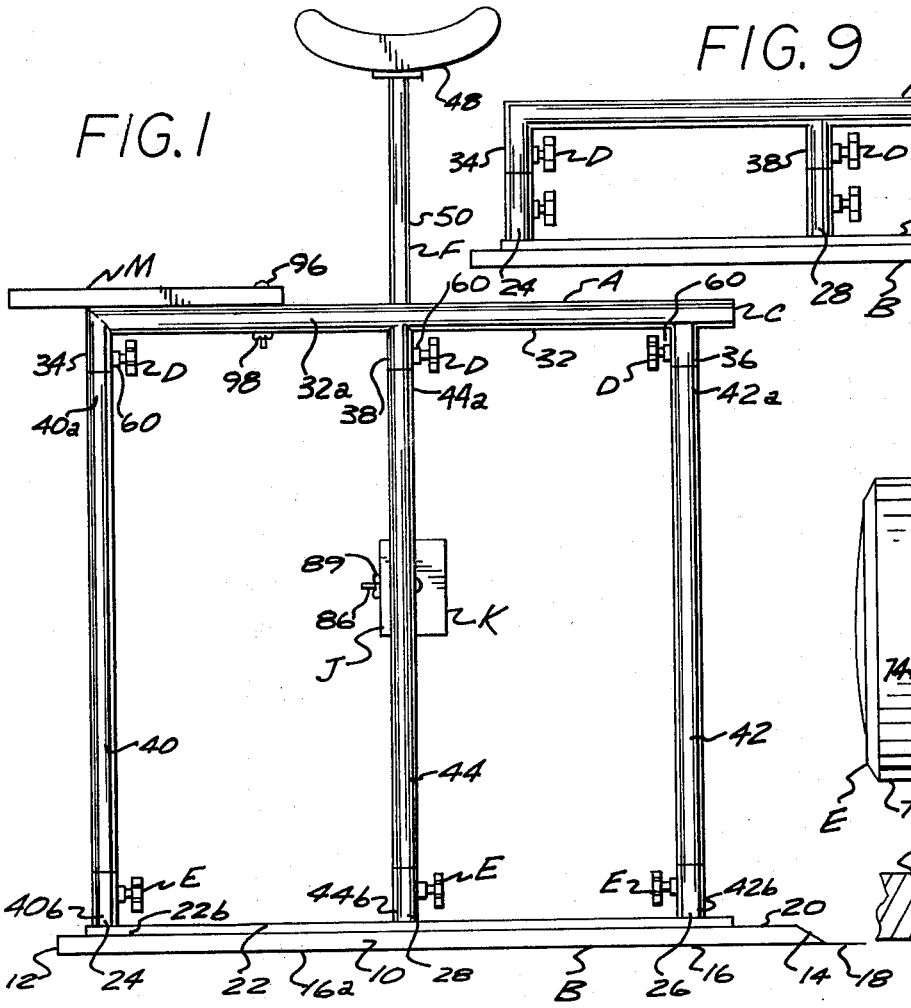
FIG. 1 is a side elevational view of the exercising device arranged in a first configuration.
Figure 2:
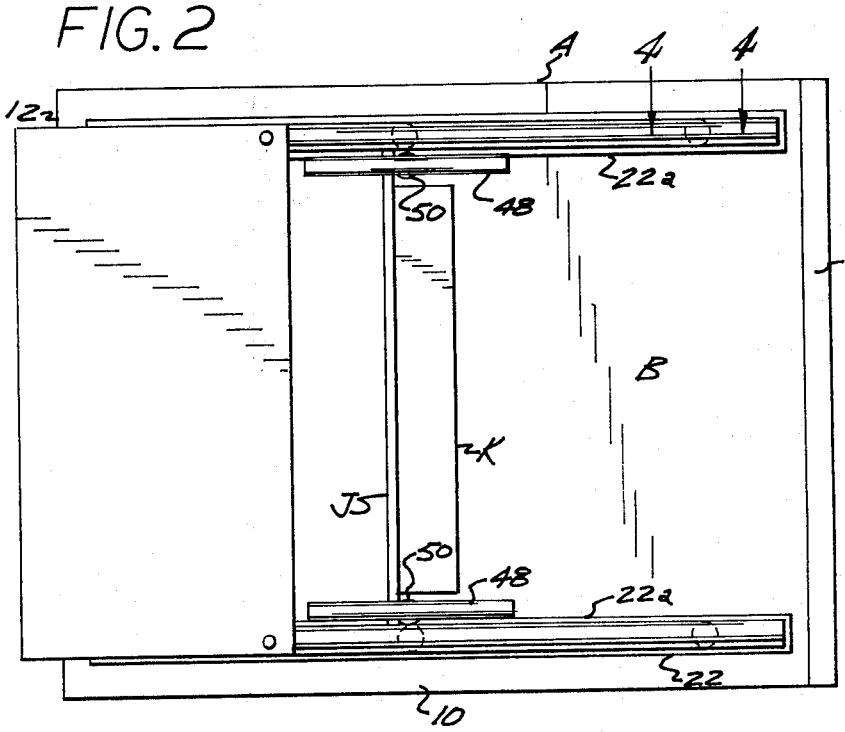
FIG. 2 is a top plan view of the device shown in FIG. 1.
Figure 5:
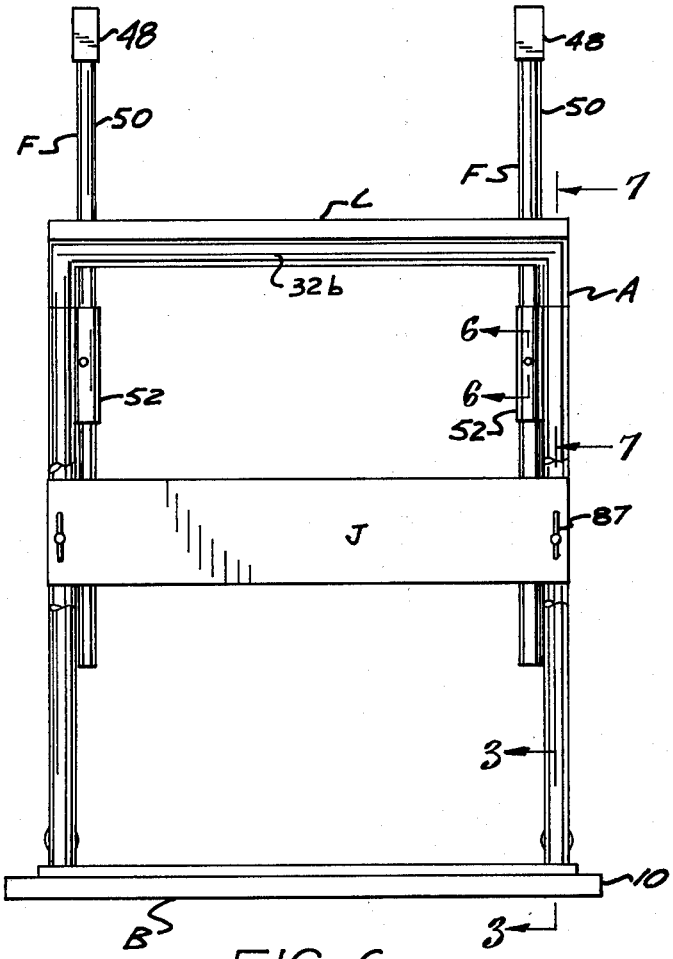
FIG. 5 is an end elevational view of the device shown in FIG. 1.

The exercising device A as can be seen in FIGS. 1, 2 and 5 includes a base assembly B. The base assembly B is defined by a rigid rectangular sheet 10 that has a forward end 12 and a rearward downwardly tapering end 14. The sheet 16 has a first side 16*a* that rests on a floor surface 18, and a second upwardly disposed horizontal side 20.

A rigid metallic U-shaped member 22 is secured to the second side 20 of sheet 10 by conventional means (not shown). The U-shaped member 22 includes two laterally spaced legs 22*a* shown in FIG. 2 that are connected on forward ends thereof by a transverse web 22*b*.

Figure 3:
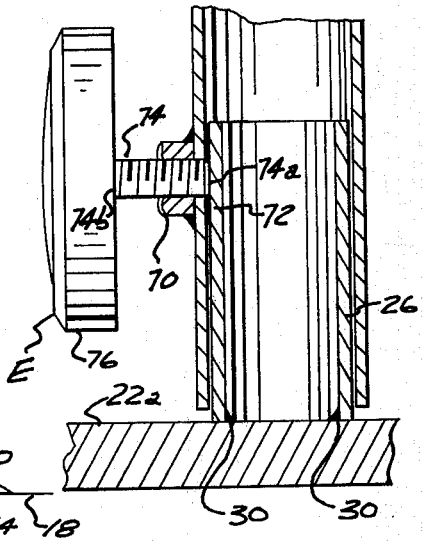
FIG. 3 is a fragmentary vertical cross sectional view of the device shown in FIG. 1 and taken on the line 3—3 of FIG. 5.
Figure 8:
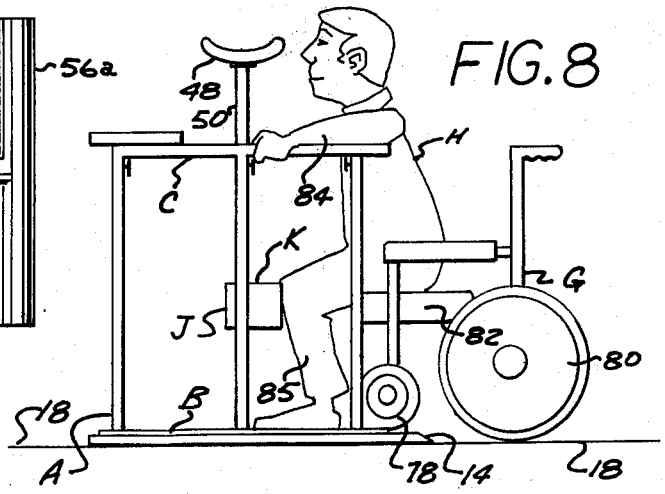
FIG. 8 is a side elevational view of the wheel chair confined person starting to move to a supported position on the invention when it is in a first configuration.

A forwardly disposed pair of studs 24, rearwardly positioned pair of studs 26, and an intermediately positioned pair of studs 28 extend upwardly from the member 22 and are rigidly secured thereto by welding beads 30 as shown in FIG. 3. The invention A when arranged in the first configuration as shown in FIG. 8 includes a support assembly C that is situated at a substantial elevation above the base assembly B as may also be seen in FIG. 1.

The support assembly C includes a U-shaped tubular member 32 that is defined by a pair of laterally spaced legs 32*a* that on the forward ends are connected by a transverse web 32*b*. The legs 32*a* have transversely aligned forwardly disposed pairs of sleeves 34, rearwardly positioned pairs of sleeves 36, and intermediately disposed positioned pairs of sleeves 38 projecting downwardly therefrom. The sleeves previously mentioned are best seen in FIG. 1.

The invention A as may be seen in FIG. 1 and FIG. 5 includes a forwardly disposed pair of vertically positionable first tubes 40, rearwardly situated pair of first tubes 42, and an intermediately positioned pair of vertically disposable intermediate tubes 44. The pairs of first tubes 40, 42 and 44 have first ends 40*a*, 42*a* and 44*a*, as well as second ends 40*b*, 42*b*, and 44*b*. The pairs of tubes 40, 42 and 44 have second tubes 46 situated within the interior thereof, and the second tubes projecting upwardly above the first ends 40*a*, 42*a* and 44*a* thereof as may be seen in FIG. 4. In the first form of the invention, the second tubes are secured to the first tubes 40, 42 and 44 be welding beads 46*a* best seen in FIG. 4.

Figure 4:
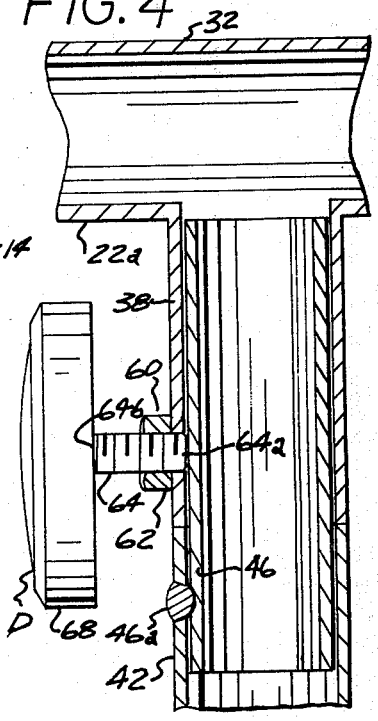
FIG. 4 is a fragmentary vertical cross sectional view of the device shown in FIG. 1 taken on lines 4—4 of FIG. 2.

First means D as may be seen in FIG. 4 are provided on the sleeves 34, 36 and 38 for removably locking the latter into engagement with the upwardly projecting portions of the second tubes 46 as may be seen in detail in FIG. 4. Second means D are mounted on the second ends 40*b*, 42*b*, and 44*b* of tubes 40, 42 and 44 for removably locking the latter in engagement with the studs 24, 26 and 28 as shown in FIG. 1.

In FIGS. 1 and 5 it will be seen that a pair of crutch like members F are provided, that include upwardly disposed arcuate supports 48 that have tubular members 50 extending downwardly therefrom. In FIG. 5 it will be seen that a pair of third tubes 52 are welded or otherwise secured to the upper portions of the intermediate first tubes 44.

Figure 6:
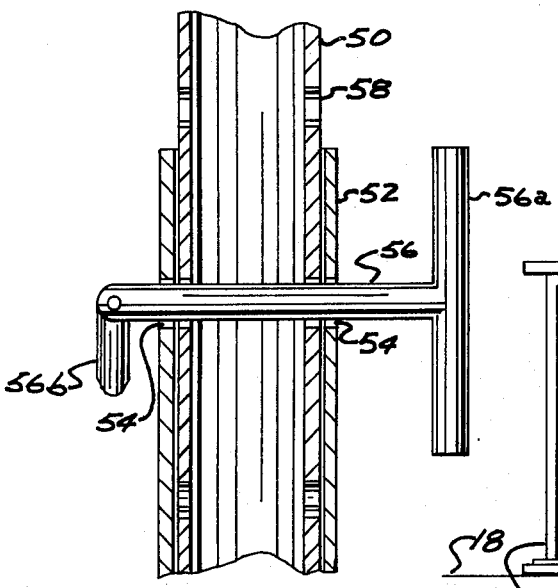
FIG. 6 is a fragmentary vertical cross sectional view of the device shown in FIG. 5 taken on the line 6—6 thereof.

The pair of third tubes 52 each have a pair of transversely aligned openings 54 formed therein as shown in FIG. 6 through which a pin 56 may be extended. When each of the pins 56 is extended through one of the openings 54 it may be caused to engage any one of the pairs of longitudinally spaced openings 58 formed in the tubular members 50. By the use of the pin, engaging the openings above described, the crutch like members F may be disposed at any desired elevation about the support assembly C as best seen in FIG. 1. Each pin 56 may be of the design shown in FIG. 6, with a handle 56*a* on one end, and a pivoted restraining member 56*b* on the opposite end, member 56*b* prevents the pin 56 with which it is associated from being inadvertently displaced from the openings previously identified.

The first means D on the sleeves 34, 36 and 38 as may best be seen in FIG. 4 include nuts 60 that are rigidly secured to the sleeves, and with the tapped bores in the nuts in alignment with transverse bores 62 formed in the sleeves. Each nut 60 is engaged by a threaded rod 64 having a first end 64*a* and second end 64*b*. The end 64b has a handle 68 secured thereto as best seen in FIG. 4. By rotating the handles 68, the rods may be rotated to bring the first ends 64*a* thereof into pressure frictional contact with upwardly extending portions of the second tubes 46, to removably hold the forward, rearward and intermediately positioned pairs of first tubes 40, 42 and 44 in locked engagement with the support assembly C as illustrated in FIGS. 1 and 8.

The pairs of first tubes 40, 42 and 44 have nuts 70 secured to the lower side portions thereof as shown in FIG. 3, with the tapped interiors of the nuts being in alignment with transverse openings 72 formed in the studs 24, 26 and 28. The nuts 70 are engaged by threaded rods 74 having first ends 74*a* and second ends 74*b*. Handles 76 are secured to the second ends 74*b* and permit the rod 74 to be rotated to bring the first end 74*a* thereof into pressure contact with the stud 24, 26 and 28 to removably secure the tubes 40, 42 and 44 to the base assembly B as shown in FIGS. 1 and 8.

A wheel chair G is shown in FIG. 8 that has a forwardly disposed pair of wheels 78 and rearwardly situated pair of wheels 80. The chair 60 includes a seat 82 on which the person H having incapacitated legs 85 is situated. The person H in using the invention A manipulates the wheel chair G to the position shown in FIG. 8 where the person H may grasp the support assembly C by his arms 84.

When the invention A is in the first configuration as shown in FIG. 8, the invention will include a cross piece J having a pair of vertically extending slots 87 formed therein through which a pair of bolts 86 extend. The pair of bolts 86 extend through pairs of aligned openings formed in the intermediate tubes 44, with the bolts having the projecting ends thereof engaged by nuts 89. By loosening and tightening the nuts 89 the cross piece J due to the vertically extending slots 87 therein may be adjusted to a desired elevation relative to the intermediate tubes 44.

The cross piece J serves to support a rearwardly extending horizontally positioned cushion K as shown in FIGS. 1 and 8. When the wheel chair confined person H has positioned the wheel chair G as shown in FIG. 8, the person may place his knees 85*a* against the cushion K and then use his arms 84 to pull himself to an upright position. After being situated in an upright position, the person H can support himself on the arcuate supports 48 that extend under his arms. The person H may then exercise, and after the exercise is completed the above described sequence of steps is reversed to place the person H in the wheel chair G. The wheel chair G may then be moved away from the exercising device A.

Figure 7:
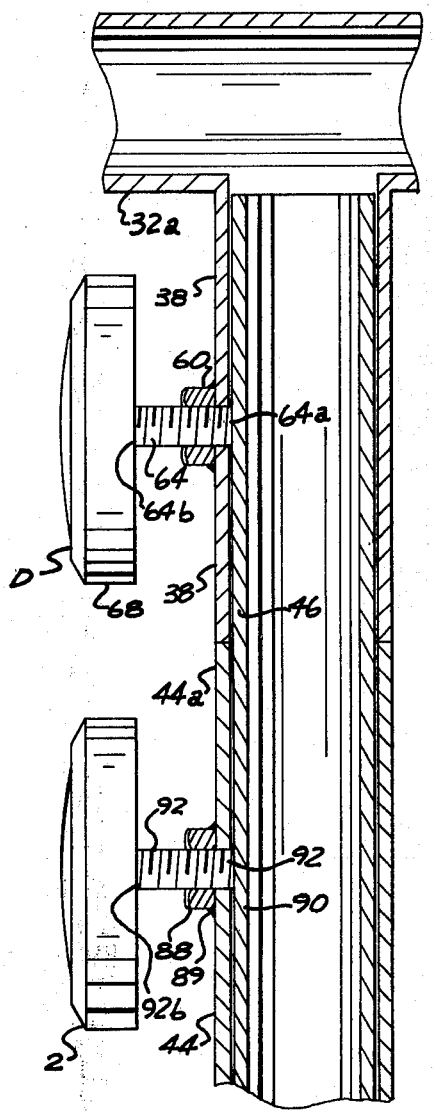
FIG. 7 is a fragmentary vertical cross sectional view of an alternate structure for the invention taken on the line 7—7 of FIG. 5.

An alternate construction of the invention A is shown in FIG. 7 in which it will be seen that the second tubes 46 are slidably movable relative to the forward, rearward, and intermediate disposed pairs of first tubes, 40, 42 and 44. In this alternate form of construction, the support C may be positioned at a greater elevation above the base B than can be achieved by the form of the invention previously described. This alternate form of the invention is shown in FIG. 7. The inner tubes 46 in the alternate form are of substantial length.

Third means L shown in FIG. 8 are provided to hold the second tubes at desired longitudinally disposed positions relative to the first pairs of tubes 40, 42 and 44 as best seen in FIG. 7. When the second tubes 46 are projecting upwardly from the first tubes 40, 42 and 44 they may be removably engaged by the first means D in the same manner as previously described. The pairs of first tubes 40, 42 and 44 have the fastening means L on the upper side portions thereof to frictionally engage the inner tubes 46 to hold the latter at a desired longitudinal position relative to the first tubes 40, 42 and 44. The third means L include nuts 88 that are rigidly secured to the outer side surfaces of the tubes 40, 42 or 44 by welding beads 89 or other conventional means.

The internally threaded bores of the nuts 88 are in transverse alignment with transverse openings 90 formed in the tube 40, 42 or 44. Threaded rods 92 engage the nuts 88 as may be seen in FIG. 8, with the rods having first ends **92*a* and second ends 92*b*. A handle 94 is mounted on the second end 92*b* of each rod 92, and permits the rod to be rotated to force the first end 92*a* into pressure frictional contact with one of the inner tubes 46 to removably lock the inner tube at a desired elevation relative to the first tube 40, 42 or 44** with which it is associated.

The first means B and second means E operate in the alternate form of the invention in the same manner as previously described. The alternate form of the invention permits the support assembly C to be disposed at a substantially higher elevation than can be achieved when the first described form of the invention is used. To permit a person H to read a book or examine objects when the person is in an erect exercising position, a horizontal shelf M is provided that extends transversely between the arms 32a of support assembly C, and is secured thereto by bolts 96 that extend downwardly through openings (not shown) formed in the shelf and vertically aligned openings (not shown) formed in the legs 32a of the support assembly C. The bolts 96 on the underside thereof are engaged by nuts 98.

Figure 9:
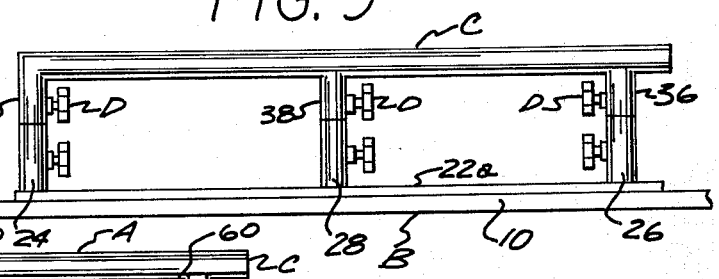
FIG. 9 is a side elevational view of the exercising device in a second configuration arranged for transportation purposes.

When it is desired to transport the invention A from one location to another, the components thereof are dismantled, and are disposed in the space defined between the base assembly B and support assembly C when the sleeves 34, 36 and 38 are in engagement with the studs 24, 26 and 28, and removably held in this position by use of the first means D being tightened to frictionally engage the studs. The supporting assembly C is in engagement with the components in the space between the supporting assembly C and the base assembly B as shown in FIG. 9, and prevents them from being inadvertently dislodged from the invention when it is in the second configuration.

The use and operation of the invention has been described previously in detail and need not be repeated.

I claim:

1. A portable device which in a first configuration permits a person having the use of his arms but due to an infirmity of his legs is confined to a wheel chair having forwardly and rearwardly disposed sets of wheels to exercise, said device capable of being dismantled from said first configuration to a second configuration where the elements thereof nest together and occupy a minimum of space to permit the convenient transportation of said device from one location to another, said device including:

a. a base assembly that includes a rigid sheet that has a first floor contactable side and a second side said sheet having forward and rearward ends, said rearward end tapering from said second side to said first side to permit said forwardly disposed set of wheels to roll upwardly into said second side from said floor, and forward, rearward and intermediate pairs of transversely aligned studs that project upwardly from said second side when said device is in said first configuration and said first side rests on a floor surface;

b. a support assembly that includes a generally U-shaped rigid member that has a pair of spaced legs that have forward and rearward ends, a web that joins said forward ends, and forward, rearward and intermediate pairs of transversely aligned sleeves that project downwardly from said member and are vertically alignable with said studs, and said sleeves of such interior transverse cross section as to permit said sleeves to slidably and snuggly engage said studs when said device is in said second configuration for said member and sheet to define a space therebetween;

c. forward, rearward and intermediate disposable pairs of elongate first tubes that are vertically positionable, said tubes having upper first end portions and lower second end portions, said first end portions of lesser transverse cross section than the balance of said tubes to permit said first end portions to slidably and snuggly engage said sleeves when said device is in said first configuration, and said second end portions slidably engaging said studs when said device is so disposed;

d. first means on said sleeves for removably holding said first end portions of said first tubes in locked engagement therewith;

e. second means on said second end portions of said tubes for removably holding said second end portions in locked engagement with said studs;

f. a pair of laterally spaced crutch like means that are adjacently disposed to said intermediate first tubes when said device is in said first configuration;

g. third means on said intermediate first tubes for adjustably and removably supporting said crutch like means at a desired upwardly extending positions relative said intermediate tubes;

h. a cross piece;

i. fourth means for removably securing said cross piece to said third means when said device is in said first configuration; and j. rearwardly extending cushion means secured to said cross piece disposed to oppose the knees of said person, with said person when using said device advancing said wheel chair relative to said base until said forward wheels rest on said second side, said person then grasping said legs of said support assembly and with the legs of said person in contact with said cushion means pulling himself to an upright position where said crutch means extend under his arms to support a major portion of the weight of said person whereupon said person may exercise; and said device when not in use being disposed in said second configuration with said tubes, crutch like means, crosspiece and cushion means disposed in said space between said sheet and support assembly and held therein by contact with said support assembly.

2. A device as defined in claim 1 which in addition includes:

k. a shelf that is transversely disposable and rests on the upper forward portions of said legs of said support assembly when said device is in said first position; and l. fifth means for removably securing said shelf to said legs of said support assembly to permit a book or other article to be supported on said shelf as said person exercises.

3. A device as defined in claim 1 in which said first end portions of said first tubes are defined by second tubes of smaller diameter that project from said first tubes, and said second tubes permanently secured in fixed positions to said first tubes.

4. A device as defined in claim 1 in which said sleeves have transverse tapped bores therein, and said first means are externally threaded rods that engage said tapped bores, said rods having inner and outer ends with said first means also including handles on said outer ends to permit said rods to be rotated for said inner ends to frictionally engage said first end portions of said tubes and removably lock the same in engagement with said sleeves.

5. A device as defined in claim 1 in which said forward, rearward and intermediate pairs of first tubes have transverse tapped bores in said second lower portions thereof, and said second means are externally threaded rods that engage said tapped bores, said rods having inner and outer ends, with said second means also including handles on said outer ends to permit said rods to be rotated for said inner ends to frictionally engage said studs and removably lock said studs to said second end portions.

6. A device as defined in claim 1 in which each of said crutch like means includes:

k. an elongate supporting member that has an upper concave edge portion that is disposed under an arm of said person; and l. an elongate tubular member that extends downwardly from said supporting member.

7. A device as defined in claim 6 in which said third means includes:

m. a pair of third tubes rigidly secured to said intermediate first tubes and parallel thereto, each of said third tubes having a pair of transversely aligned first openings therein;

n. a pair of pins that can removably engage said first pairs of openings in said pair of third tubes as well as any desired pairs of a pluarlity of pairs of longitudinally spaced second openings in said pair of tubular members to adjustably support said tubular members at desired elevation for said person when the latter is in an erect position.

8. A device as defined in claim 1 in which said first end portions of said forward, rearward, and intermediate first tubes of lesser diameter that project therefrom and are slidable relative thereto, and said device in addition including:

k. fifth means on said forward, rearward and intermediate first tubes for adjustably locking said inner tubes in desired longitudinal positions relative thereto when said device is in said first configuration to dispose said support assembly at a desired elevation above said base assembly.

9. A device as defined in claim 8 in which said forward, rearward and intermediate first tubes have transverse tapped bores formed therein and said fifth means includes l. a plurality of threaded rods that engage said tapped bores, said rods having first and second ends; and m. a plurality of handles on said second ends to permit said rods to be rotated to force said first ends in pressure frictional contact with said inner tubes to hold the latter at a desired elevation above said base assembly.

10. A device as defined in claim 1 in which said studs are metal and in addition includes:

k. a metallic generally U-shaped member rigidly secured to said second side of said sheet; and l. a plurality of welds that permanently secure said studs to said U-shaped member.

* * * * *